US006402163B1

(12) United States Patent
Pratt

(10) Patent No.: US 6,402,163 B1
(45) Date of Patent: Jun. 11, 2002

(54) ADJUSTING THE SIZE OF A LINED SPORT BOOT

(75) Inventor: Michael K. Pratt, Worcester, MA (US)

(73) Assignee: Seneca Sports, Inc., Boston, MA (US)

( * ) Notice: Subject to any disclaimer, the term of this patent is extended or adjusted under 35 U.S.C. 154(b) by 0 days.

(21) Appl. No.: 09/245,443

(22) Filed: Feb. 4, 1999

(51) Int. Cl.[7] ..... A63C 1/99

(52) U.S. Cl. ..... 280/11.26; 280/11.221; 36/97

(58) Field of Search ..... 280/11.26, 11.3, 280/11.19, 11.221; 36/117.7, 117.1, 115, 97

(56) References Cited

U.S. PATENT DOCUMENTS

| | | | | | |
|---|---|---|---|---|---|
| 831,210 | A | * | 9/1906 | Bosley | 36/8.2 |
| 1,821,051 | A | * | 9/1931 | Brown | 36/8.4 |
| 2,572,050 | A | * | 10/1951 | Ornstein | 280/11.3 |
| 2,676,812 | A | * | 4/1954 | Owsen et al. | 280/11.2 |
| 2,952,925 | A | * | 9/1960 | Held | 36/97 |
| 4,599,811 | A | * | 7/1986 | Rousseau | 36/105 |
| 4,708,352 | A | | 11/1987 | Vullierme | 280/11.26 |
| 4,723,364 | A | | 2/1988 | Marxer | 36/10 |
| 4,893,417 | A | | 1/1990 | Dalla Lana | 36/10 |
| 4,901,450 | A | | 2/1990 | Chemello et al. | 36/10 |
| 4,910,889 | A | | 3/1990 | Bonaventure et al. | 36/117 |
| 4,969,277 | A | * | 11/1990 | Williams | 36/97 |
| 4,998,358 | A | | 3/1991 | Girardelli | |
| 5,174,050 | A | | 12/1992 | Gabrielli | 36/117 |
| 5,184,834 | A | | 2/1993 | Yu | 280/7.13 |
| 5,224,718 | A | | 7/1993 | Gertler | 280/11.19 |
| 5,279,053 | A | | 1/1994 | Pallatin et al. | 36/117 |
| 5,289,645 | A | | 3/1994 | Marega et al. | 36/54 |
| 5,317,821 | A | | 6/1994 | Vargo | 36/93 |
| 5,397,141 | A | * | 3/1995 | Hoshizaki et al. | 280/11.3 |
| 5,400,484 | A | | 3/1995 | Gay | 24/585 |
| 5,430,959 | A | | 7/1995 | Mitsui | 36/88 |
| 5,570,523 | A | * | 11/1996 | Lin | 36/112 |
| 5,645,288 | A | | 7/1997 | Lu | 280/11.26 |
| 5,669,160 | A | | 9/1997 | Pozzebon | 36/10 |
| 5,673,448 | A | | 10/1997 | Lang et al. | 12/142 R |
| 5,678,833 | A | | 10/1997 | Olson et al. | 280/11.22 |
| 5,746,015 | A | | 5/1998 | Clement et al. | 36/93 |
| 5,761,830 | A | | 6/1998 | Condini | 36/10 |
| 5,794,362 | A | * | 8/1998 | Polk, III et al. | 36/97 |
| 5,842,293 | A | * | 12/1998 | Young | 36/97 |
| 6,050,004 | A | * | 4/2000 | Miralles et al. | 36/97 |

FOREIGN PATENT DOCUMENTS

| | | |
|---|---|---|
| EP | 0107841 A1 | 5/1984 |
| EP | 0692202 A1 | 1/1996 |

OTHER PUBLICATIONS

Search Report dated Apr. 12, 2000.

* cited by examiner

*Primary Examiner*—Robert P. Olszewski
*Assistant Examiner*—James S. McClellan
(74) *Attorney, Agent, or Firm*—Fish & Richardson P.C.

(57) ABSTRACT

An adjustable skate boot has an adjustable boot shell of multiple, rigid pieces, and an adjustable liner adapted to provide an inner cushion for the shell. The soft, padded tricot liner has a fore portion and a heel portion which are adapted to be overlapped in use, the amount of overlap being adjustable for accommodating feet of different sizes. Hook-and-loop fasteners provide a releasable engagement for connecting the fore and heel portions of the liner. Methods of adjusting the liner are also disclosed.

15 Claims, 5 Drawing Sheets

ADJUSTING THE SIZE OF A LINED SPORT BOOT

BACKGROUND OF THE INVENTION

This invention relates to liners for skate and ski boots and the like.

Sport boots, such as for in-line skates and skis, typically have shells formed of a rigid material, such as molded plastic. Inner booties or liners are generally provided for such boots, for cushioning, comfort and fit.

Some sport boots are adjustable in length to accommodate feet of different sizes, such as the in-line skate boot disclosed in my pending U.S. Application Ser. No. 09/017,420, filed Feb. 2, 1998. Adjustability of the size of sport boots advantageously lowers the number of skates needed to be kept as inventory by rental facilities, for instance, enables such boots to be readily shared, and also reduces the number of boots needed over the course of a child's growth.

Summary of the Invention

The invention described herein features an improved liner for adjustable sport boots, such as those having rigid shells which enclose the wearer's foot, which is adapted to provide an inner cushion for the shell.

According to one aspect, the liner includes a fore portion and a heel portion. The fore portion has a fore upper and a fore sole, the fore upper and fore sole together defining a toe box, and a liner tongue extending rearward from the toe box. The heel portion has a heel upper and a heel sole, and defines a cavity for receiving a heel of a wearer. The fore and heel portions have respective surfaces arranged to overlap each other in use, the amount of overlap of the respective surfaces being adjustable for accommodating feet of different sizes.

Various embodiments may contain one or more of the following features. The respective surfaces include portions of respective side walls of the fore and heel uppers extending upward from the fore and heel soles, respectively. Inner surfaces of the side walls of the fore upper engage outer surfaces of the side walls of the heel upper. The fore sole is arranged to overlap the heel sole in use. The respective surfaces carry mating fasteners (such as hook-and-loop fasteners) arranged for releasable engagement. Both the fore and heel portions are constructed of a foam-padded tricot material. The amount of overlap of the respective surfaces is adjustable over a range of at least about ½ inch. One of the fore sole and heel sole carries a series of indicia (such as standard shoe size indications) corresponding to the amount of overlap, as adjusted, of the respective surfaces. The fore upper extends rearward to cover either side of an ankle of the wearer.

According to another aspect, the invention provides a useful combination of the above-described liner and a skate having a boot with a rigid shell and a wheeled chassis. The boot shell is adapted to enclose a wearer's foot and have overlapping toe and heel portions, the amount of overlap of the toe and heel portions being adjustable for accommodating feet of different sizes. The liner is disposed within the boot shell, but is removable from the shell for adjustment.

According to another aspect, the invention provides a method of adjusting the size of a skate, comprising the steps of:

(a) providing the above-described combination skate and liner;

(b) adjusting the overlap of the respective surfaces of the fore and heel portions of the liner to accommodate a wearer's foot; and (c) adjusting the overlap of the toe and heel portions of the boot shell to accommodate the wearer's foot.

The method includes, in some embodiments and between steps (a) and (b), the step of (d) removing the liner from the skate boot shell and, after step (c), the step of (e) returning the adjusted liner to the boot shell.

The method includes, in some embodiments and between steps (a) and (b), the step of (d) removing the liner from the skate boot shell and, between steps (b) and (c), the step of (e) returning the adjusted liner to the boot shell.

The liner of the invention can provide an acceptable level of support and padding in multiple, easily selectable and adjustable size configurations. Besides enabling multiple users a more accommodating fit in a single pair of sport boots, the invention is also useful for adapting a single pair of boots to a single child through multiple shoe sizes. Instead of having to buy liners of different sizes, users may adjust a single liner as needed.

DESCRIPTION OF EMBODIMENTS

Figure 1:
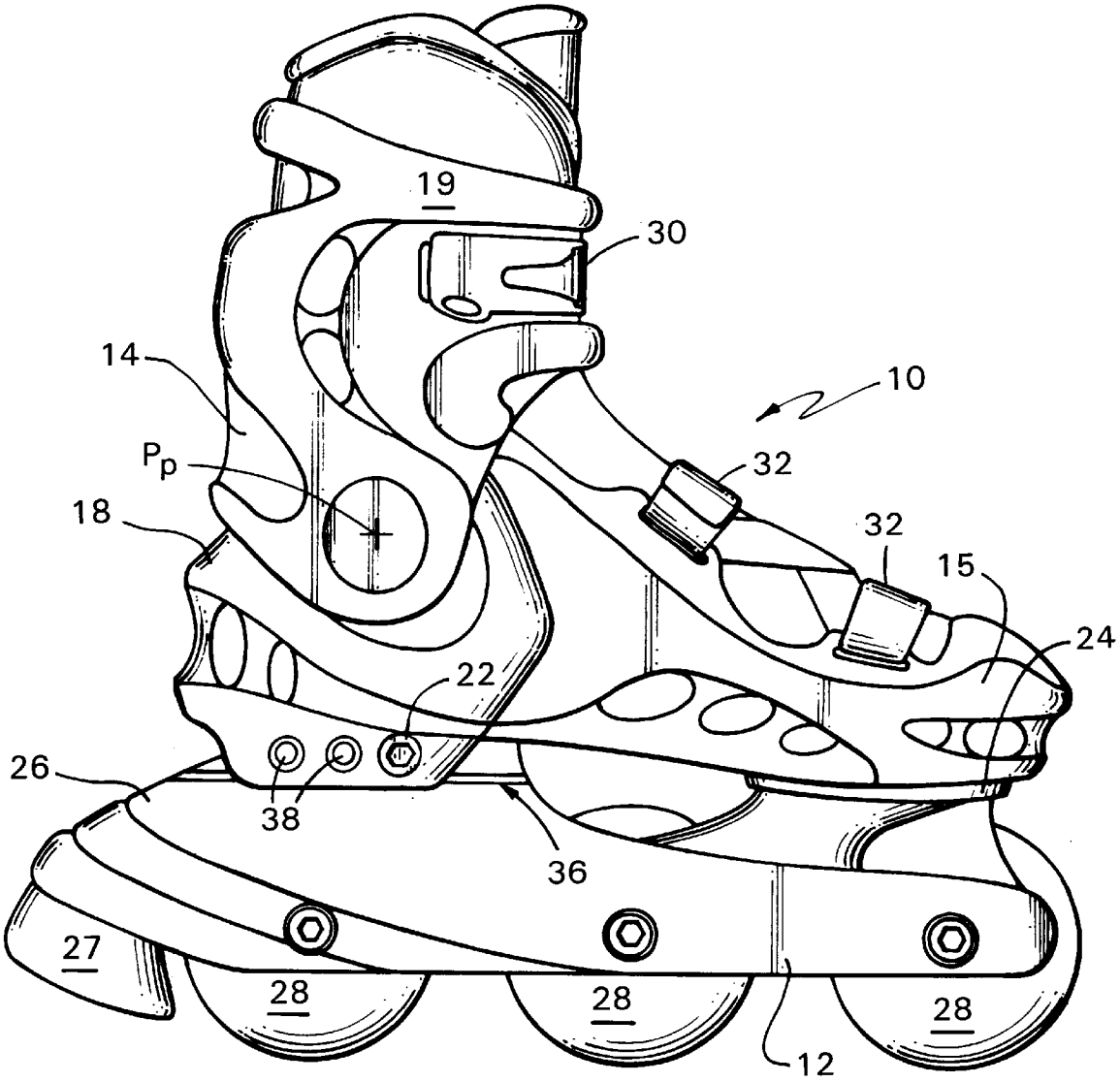
FIGS. 1 and 2 are side views of an adjustable in-line skate, shown adjusted to two different sizes.
Figure 2:
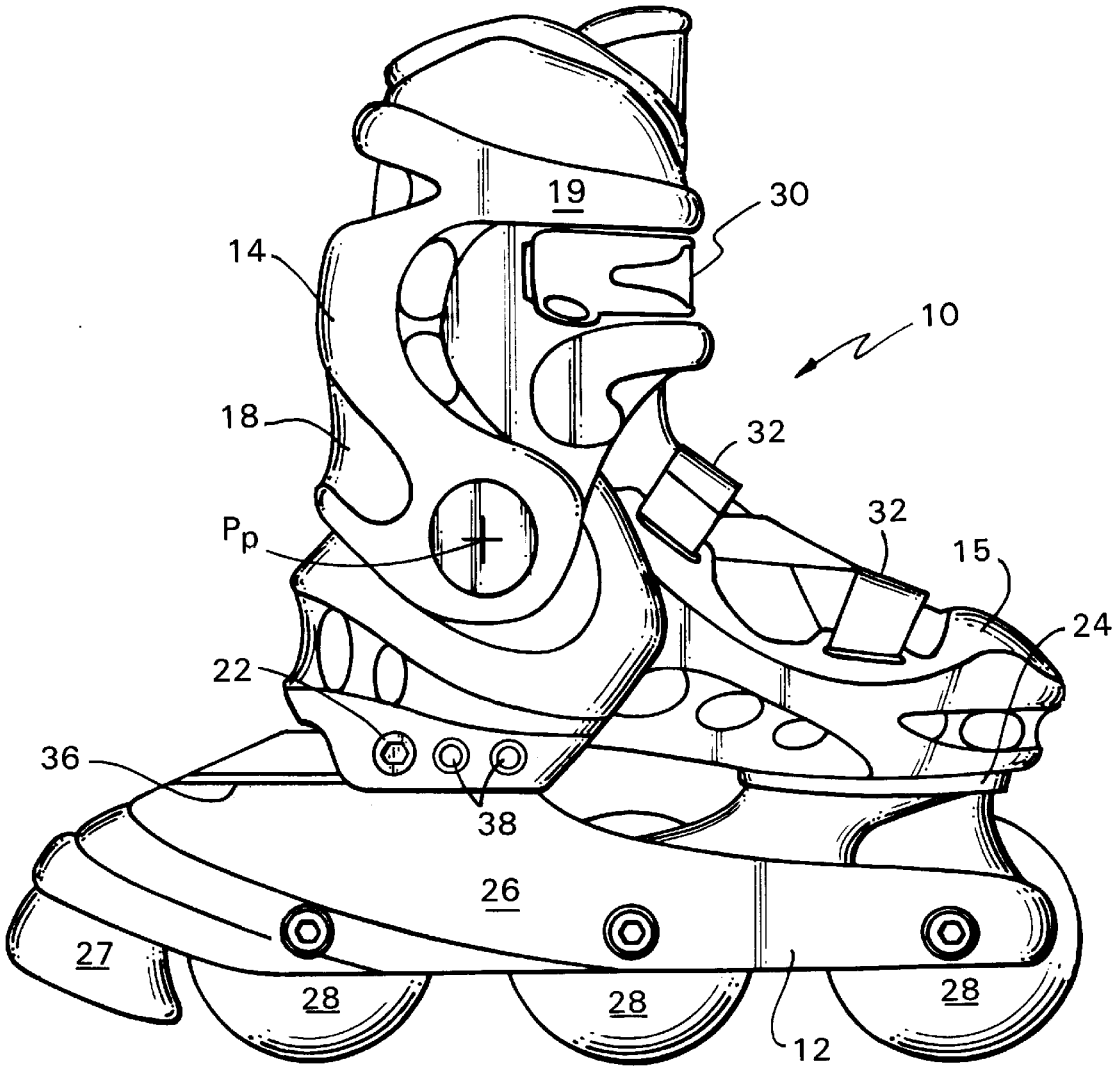

Referring to FIGS. 1 and 2, adjustable in-line skate 10 has a wheeled chassis 12 and an adjustable boot 14. Chassis 12 has a frame 26, a plurality of wheels 28 which are individually mounted for rotation to the chassis frame, and a braking pad 27. Boot 14 has a fore portion 15 for enclosing the toes and forefoot of the wearer, and a heel counter 18 for enclosing the wearer's heel and ankle. Pivotally attached to the heel counter at pivot point $P_p$ is a tendon guard 19, which carries an adjustable lever ratchet closure 30 (as known in the art) for tightening the tendon guard about the wearer's leg. Two additional closures 32 are located on the fore portion of the boot. Each of the fore portion 15, the heel counter 18 and the tendon guard 19 are fashioned of molded, rigid plastic, similar in material to those of other modern sport boots. Although illustrated with respect to a sport boot for an in-line skate, the invention is not intended to be limited to in-line skates but is also applicable to other types of sport boots, such as ski or snowboard boots, for example.

The fore portion 15 is firmly and permanently attached to chassis frame 26 at a forward chassis plate 24. Connection of the fore portion to the chassis may be by any means currently employed to attach an in-line skate boot to a wheeled chassis, including fasteners and adhesives. Heel counter 18, however, is adapted to be fixed to the chassis frame at any of a number of positions along the toe-heel axis of the skate, and moved between such positions for adjusting the size of the boot. In any of its in-use positions, the heel counter and fore portion overlap, both at their soles and their side walls. As the heel counter and tendon guard are moved fore and aft, the amount of resulting overlap between the side walls and sole of the heel counter and fore portion varies, with the side walls and sole of the fore portion inboard of the side walls and sole of the heel counter in the embodiment shown. FIG. 2 shows the skate adjusted to a smaller size than as configured in FIG. 1.

The fore/aft position of heel counter 18 is established by sliding two inwardly-facing tabs of the heel counter (not shown) along corresponding channels 36 in chassis frame 26 to align one of a series of fastener openings 38 with a corresponding lateral hole through the chassis frame (not shown) and inserting a removable fastener 22 (such as a socket-head cap screw) through the aligned fastener opening and the lateral hole. So attached, the heel counter (and connected tendon guard) are prevented from separating vertically from the chassis by the tabs engaging channel 36 and by fastener 22. To further adjust the size of the skate boot, fastener 22 is removed, the heel counter is adjusted to align a different opening 38 with the lateral hole of the chassis, and the fastener is reinserted and tightened. Other details of a presently preferred skate boot and chassis may be found in my U.S. patent application Ser. No. 09/017,420, filed Feb. 2, 1998, the entire contents of which are incorporated herein by reference as if fully set forth.

Figure 3:
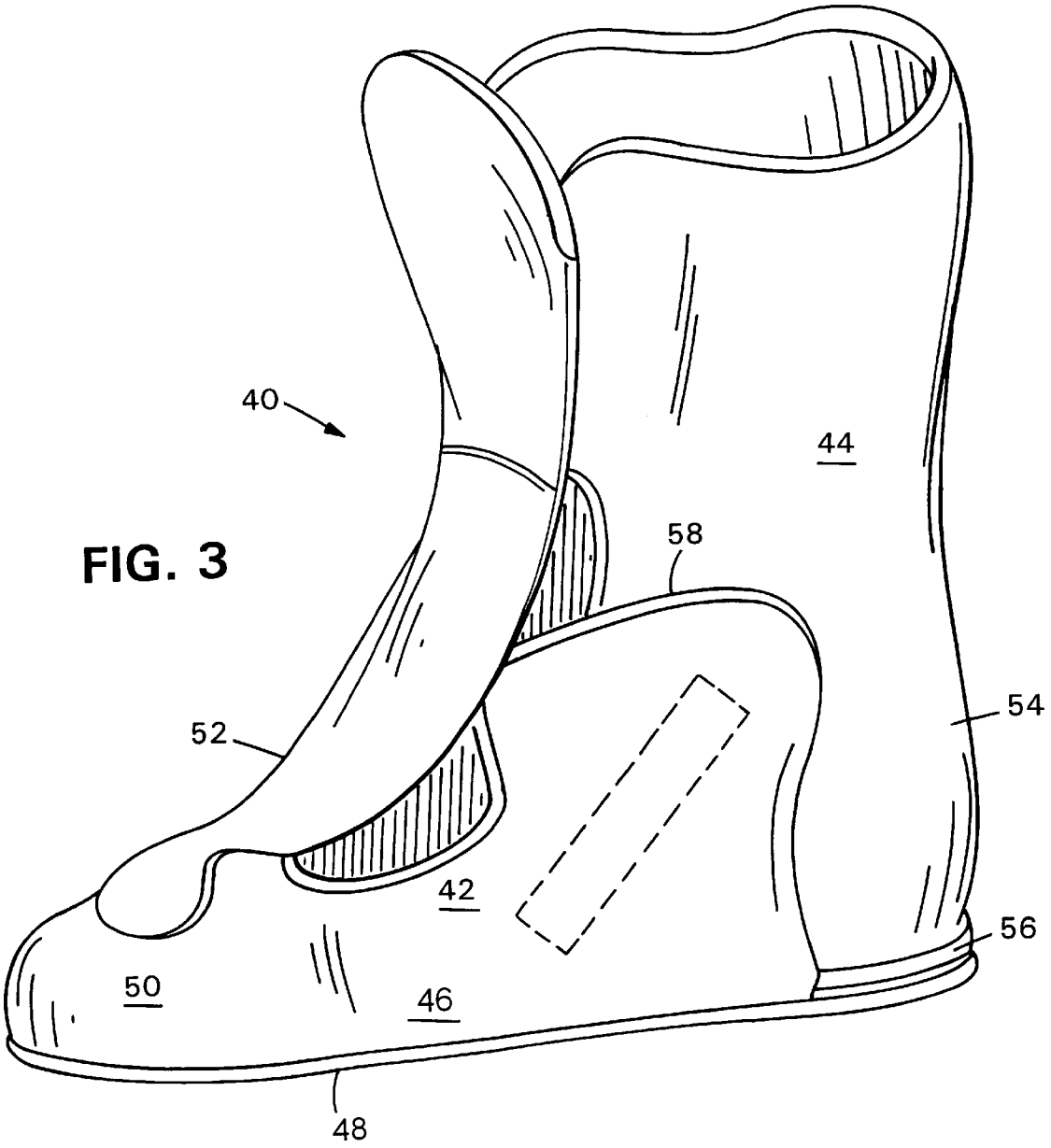
FIG. 3 is a perspective view of a skate boot liner.

Referring to FIG. 3, a two-piece liner 40 is fashioned for use in an adjustable boot, such as the adjustable boot 14 of the above-described in-line skate 10. Made of foam-padded tricot, stitched together to approximate the shape of the inside cavity of boot 14, liner 40 provides an inner cushion for the boot that protects the wearer's foot and ankle from direct contact with rigid plastic surfaces of the boot and helps to provide a comfortable, snug fit of foot to boot.

Liner 40 consists of two separable components: a fore portion 42 and a heel portion 44 that are adapted to be secured to each other with various amounts of fore-aft overlap to fit different size feet. Fore portion 42 has a fore upper 46 and a fore sole 48, stitched together about three sides of the perimeter of the fore sole to form a toe box 50. A tongue 52 is stitched to the top of, and extends rearward from, the toe box, but is otherwise loose. Fore upper 46 also forms vertically extending ears 58, one on each side of the liner. Heel portion 44 has a heel upper 54 and a heel sole 56, stitched together about the sides of the perimeter of the heel sole to form a U-shaped cavity 57 (FIG. 5) for receiving and enclosing the wearer's heel.

The outer Elide surfaces of heel upper 54 extend inside of, and overlap, the inner side surfaces of fore upper ears 58, and the fore sole 48 overlaps heel sole 56. The amount of each of these overlaps is adjustable for accommodating feet of different sizes. Fore upper ears 58 preferably extend rearward far enough to cover, and provide additional padding for, the wearer's ankle.

Figure 4:
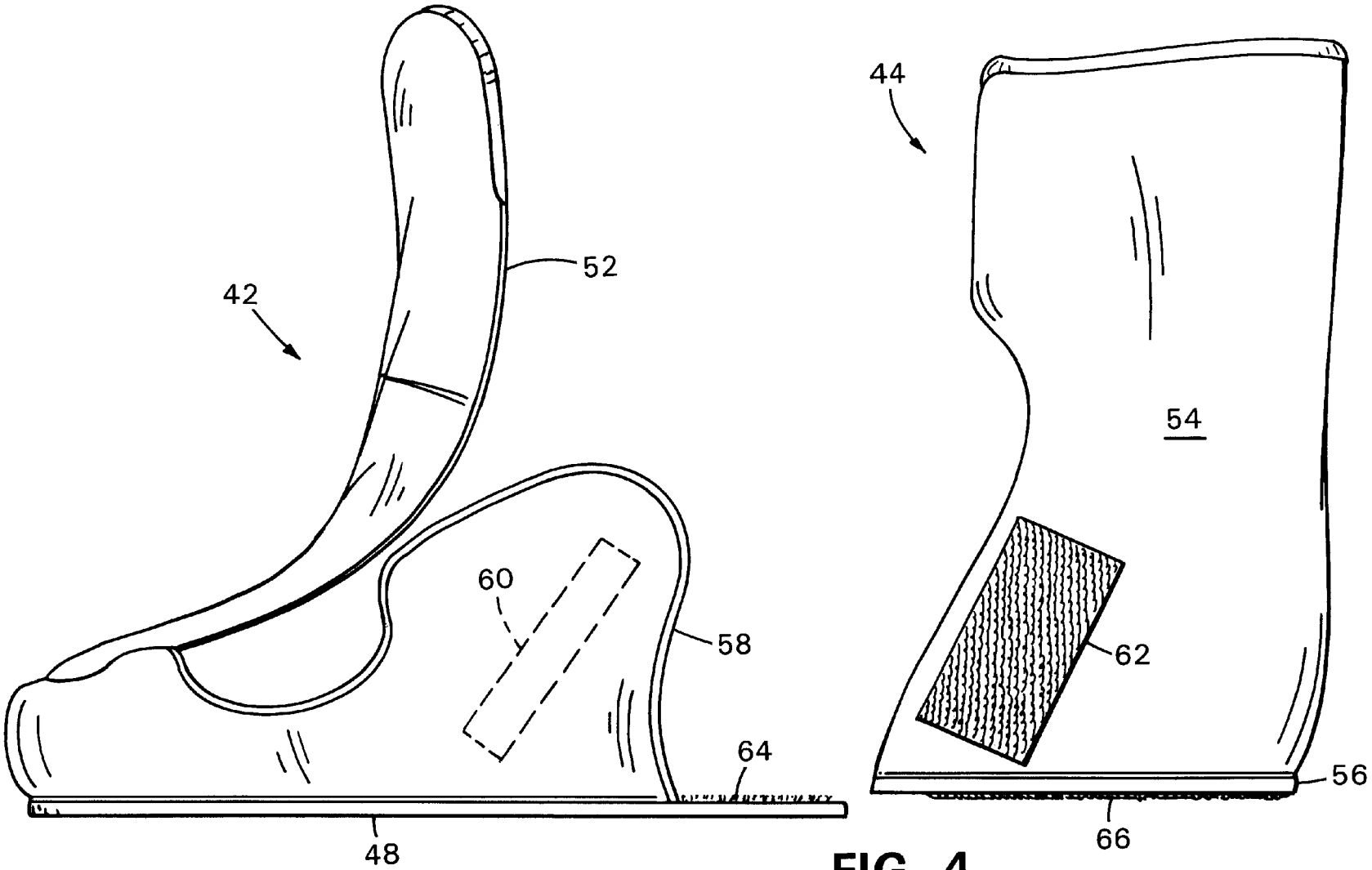
FIG. 4 is an expanded side elevation view of the liner, with fore and heel portions separated.

Referring to FIG. 4, a strip of hook fastener material 60 (for hook-and-loop fastening, such as is sold under the VELCRO trademark) is stitched to the inner side surface of each of the fore upper ears 58, and a corresponding patch of cooperating loop material 62 is stitched to the outer side surfaces of heel upper 56. Hook material 60 and loop material 62 are each positioned such that there will be a significant area of engagement between the two materials with the liner in any of its intended configurations. In addition, a wide patch of hook material 64 is applied to the most rearward portion of the upper surface of fore sole 48, and a corresponding patch of loop material 66 is fixed to the lower surface of heel sole 56.

Figure 5:
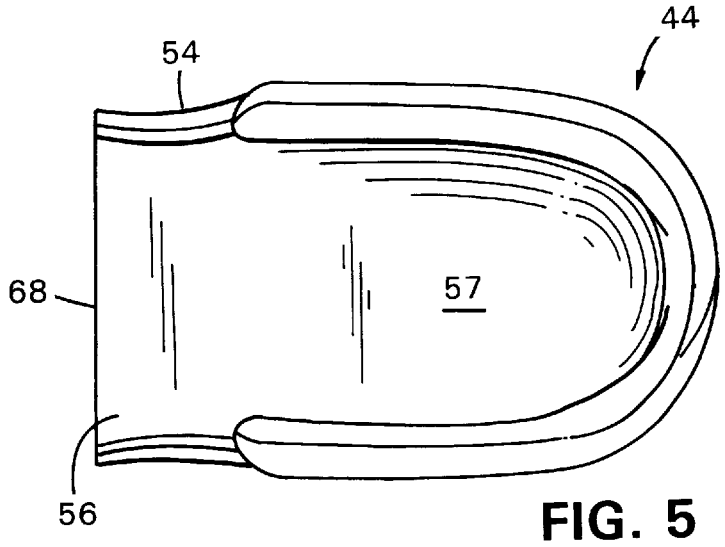
FIG. 5 is a top view of the heel portion.
Figure 6:
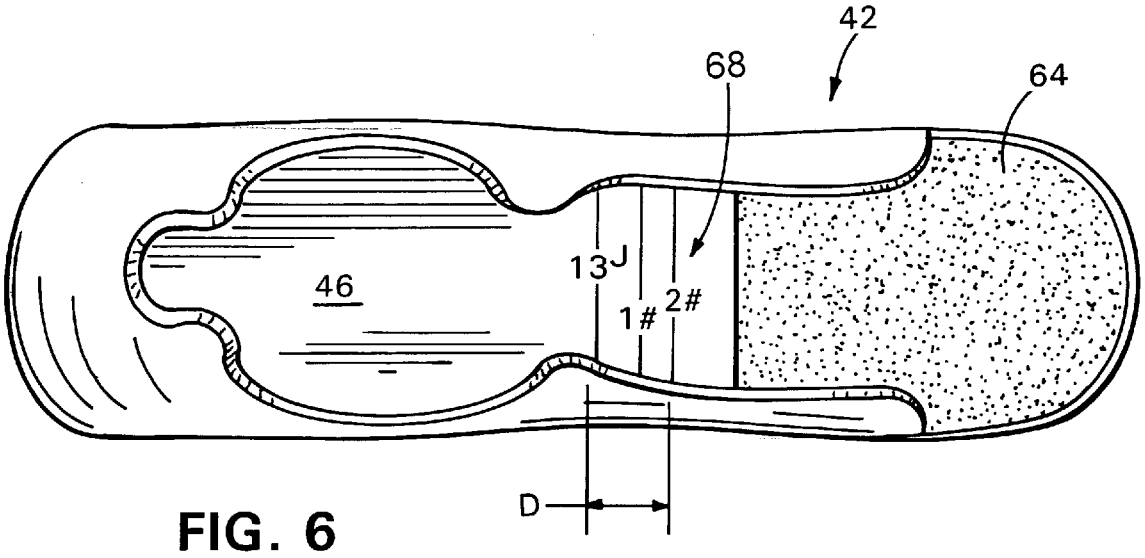
FIG. 6 is a top view of the fore portion, with the tongue cut away to show the inner surface of the fore sole.

Referring to FIGS. 5 and 6, the inner surface of the fore sole 46 of fore portion 42 is provided with overlap indicia 68 (FIG. 6) for indicating the size of the liner, corresponding to the amount of overlap between the fore and heel portions of the liner. Indicia 68 includes a series of parallel lines, as shown, with each line identified by a symbol which may indicate a standard shoe size. In the illustrated embodiment, for instance, the most rearward line (corresponding to the largest of the three indicated sizes) is labeled "2#", indicating a child's size 2; the middle line is labeled "1#", for child's size 1; and the most forward line is labeled "13J", for juniors'size 13. In this particular embodiment, the distance, D, between the foremost and rearmost indicia lines is about ½ inch. The heel sole 56 of heel portion 44 has a forward edge 68 (FIG. 5) that lines up with any one of the parallel lines of the fore sole indicia to indicate the relative size of the adjusted liner. The indicia of the embodiment shown correspond to the three fastener openings 38 of the skate boot of FIG. 1, near which corresponding indicia may also be provided. It should be realized, however, that hook-and-loop fasteners allow engagement at any position across a given range, rather than only at discrete positions. Thus, liner 40 may be adjusted for a more comfortable fit, as necessary, between indicated sizes.

To adjust the size of skate 10 of FIG. 1, in combination with the liner 40 of FIG. 3, the wearer removes the liner from the boot and adjusts the overlap of toe and heel portions 42 and 44 of the liner to accommodate his or her foot. The size of the skate boot may be adjusted separately, either with or without the adjusted liner in place. It may be convenient under some circumstances to leave the adjusted liner 40 on one's foot and insert the foot and liner together into the boot shell before adjusting the size of the boot.

Other variations and embodiments will be apparent to those of ordinary skill in the art upon learning of this invention, and will be understood as falling within the scope of the following claims. For instance, the fore portion 42 of liner 40 may be permanently attached to fore portion 15 of the boot shell, such as by rivets attaching fore upper ears 58 to the side walls of boot shell fore portion 15, with only the heel portion 44 of the liner removable from the boot shell. The hook-and-loop fasteners shown may be readily replaced with other types of fasteners, such as snaps or flexible sheet magnets. While it is presently preferred to releasably connect the fore and heel portions of the liner together, such as by the touch fasteners shown herein, it will be understood that such connection is not required in all circumstances and that such non-attaching, multiple-piece liners are contemplated as within the scope of the invention.

What is claimed is:

1. A liner for a rigid sport boot shell, the liner adapted to provide an inner cushion for said shell and comprising a fore portion having a fore upper and a fore sole, the fore upper and fore sole together defining a toe box, and a liner tongue extending rearward from the toe box; and a heel portion having a heel upper and a heel sole, the heel portion defining a cavity for receiving a heel of a wearer, the fore and heel portions together fitting within the rigid sport boot shell and having respective surfaces arranged to overlap each other in use, the amount of overlap of said respective surfaces being adjustable for accommodating feet of different sizes.

2. The liner of claim 1 wherein said respective surfaces comprise portions of respective side walls of the fore and heel uppers extending upward from the fore and heel soles, respectively.

3. The liner of claim 2 wherein inner surfaces of the side walls of the fore upper engage outer surfaces of the side walls of the heel upper.

4. The liner of claim 1 wherein the fore sole is arranged to overlap the heel sole in use.

5. The liner of claim 1 wherein said respective surfaces carry mating fasteners arranged for releasable engagement.

6. The liner of claim 5 wherein said mating fasteners comprise hook-and-loop fasteners.

7. The liner of claim 1 wherein both the fore and heel portions are constructed of a foam-padded tricot material.

8. The liner of claim 1 wherein the amount of overlap of said respective surfaces is adjustable over a range of at least about ½ inch.

9. The liner of claim 1 wherein one of the fore sole and heel sole carry a series of indicia corresponding to the amount of overlap, as adjusted, of said respective surfaces.

10. The liner of claim 9 wherein the indicia comprise standard shoe size indications.

11. The liner of claim 1 wherein the fore upper extends rearward and is adapted to cover either side of an ankle of the wearer.

12. In combination, a skate having a boot with a rigid shell and a wheeled chassis, the boot shell adapted to enclose a wearer's foot and having overlapping toe and heel portions, the amount of overlap of the toe and heel portions being adjustable for accommodating feet of different sizes; and the liner of claim 1 disposed within the boot shell, the liner being removable from the shell for adjustment.

13. A method of adjusting the size of a skate, comprising the steps of:

(a) providing the combination skate and liner of claim 12;

(b) adjusting the overlap of the respective surfaces of the fore and heel portions of the liner to accommodate a wearer's foot; and (c) adjusting the overlap of the toe and heel portions of the boot shell to accommodate the wearer's foot.

14. The method of claim 13, further comprising, between steps (a) and (b), the step of (d) removing the liner from the skate boot shell and, after step (c), the step of (e) returning the adjusted liner to the boot shell.

15. The method of claim 13, further comprising, between steps (a) and (b), the step of (d) removing the liner from the skate boot shell and, between steps (b) and (c), the step of (e) returning the adjusted liner to the boot shell.

* * * * *